US006476842B1

(12) United States Patent
Chang

(10) Patent No.: US 6,476,842 B1
(45) **Date of Patent: *Nov. 5, 2002**

(54) TRANSFER PRINTING

(75) Inventor: Samuel Chang, Arcadia, CA (US)

(73) Assignee: Olive Tree Technology, Inc., Arcadia, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1178 days.

(21) Appl. No.: 08/801,788

(22) Filed: Feb. 18, 1997

Related U.S. Application Data

(63) Continuation of application No. 08/523,335, filed on Sep. 5, 1995, now abandoned.

(51) Int. Cl.[7] ..... B41J 31/00; B41J 31/05

(52) U.S. Cl. ..... 347/217

(58) Field of Search ..... 503/227; 347/217, 347/224; 400/237, 241, 241.4; 428/195

(56) References Cited

U.S. PATENT DOCUMENTS

| | | | | | |
|---|---|---|---|---|---|
| 4,558,329 | A | | 12/1985 | Honda | 400/240.3 |
| 4,614,521 | A | | 9/1986 | Niwa et al. | 8/471 |
| 4,657,557 | A | | 4/1987 | Niwa et al. | 8/471 |
| 4,675,701 | A | | 6/1987 | Chu et al. | |
| 4,748,151 | A | | 5/1988 | Murata et al. | 503/227 |
| 4,771,035 | A | | 9/1988 | Murata et al. | 503/227 |
| 4,804,975 | A | * | 2/1989 | Yip | 347/224 |
| 4,816,435 | A | | 3/1989 | Murata et al. | 503/227 |
| 4,820,685 | A | | 4/1989 | Murata | 503/227 |
| 4,829,049 | A | | 5/1989 | Murata et al. | 503/227 |
| 4,895,830 | A | | 1/1990 | Takeda et al. | 503/227 |
| 4,954,478 | A | | 9/1990 | Taguchi et al. | 503/227 |
| 4,981,748 | A | | 1/1991 | Kawai et al. | 503/227 |
| 4,985,396 | A | | 1/1991 | Kawakami et al. | 503/227 |
| 4,988,666 | A | | 1/1991 | Taguchi et al. | 503/227 |
| 4,988,667 | A | | 1/1991 | Long | 503/227 |
| 5,004,659 | A | | 4/1991 | Vermeulen et al. | 430/14 |
| 5,008,152 | A | | 4/1991 | Mikamo et al. | 428/423.1 |
| 5,011,815 | A | | 4/1991 | Beck et al. | 503/227 |
| 5,013,606 | A | | 5/1991 | Miyoshi et al. | 428/412 |
| 5,017,547 | A | * | 5/1991 | DeBoer | 503/227 |
| 5,100,861 | A | | 3/1992 | Gemmell et al. | 503/227 |
| 5,105,206 | A | | 4/1992 | Sarraf et al. | |
| 5,139,995 | A | | 8/1992 | Taki et al. | 503/227 |
| 5,143,782 | A | | 9/1992 | Morishima et al. | 428/327 |
| 5,189,008 | A | | 2/1993 | Murata et al. | 503/227 |
| 5,236,768 | A | | 8/1993 | Fujii et al. | 428/195 |
| 5,256,492 | A | | 10/1993 | Hirota et al. | 428/524 |
| 5,292,583 | A | | 3/1994 | Taki et al. | 428/323 |
| 5,308,681 | A | | 5/1994 | Taki et al. | 428/195 |
| 5,314,862 | A | | 5/1994 | Hirota et al. | 503/227 |
| 5,324,583 | A | | 6/1994 | Ozaki | 428/336 |
| 5,326,622 | A | | 7/1994 | Yamane et al. | 428/200 |
| 5,350,730 | A | | 9/1994 | Hirota et al. | 503/227 |
| 5,553,951 | A | | 9/1996 | Simpson et al. | |

FOREIGN PATENT DOCUMENTS

| | | | | |
|---|---|---|---|---|
| JP | 54-116248 | | 10/1979 | |
| JP | 60-137693 | * | 7/1985 | 347/217 |
| JP | 60-174689 | * | 9/1985 | 347/217 |
| JP | 60-253584 | * | 12/1985 | 347/217 |
| JP | 1-294069 | | 11/1989 | |
| JP | 4-80052 | | 3/1992 | |
| JP | 4-85048 | | 3/1992 | |

* cited by examiner

*Primary Examiner*—Huan Tran
(74) *Attorney, Agent, or Firm*—Oblon, Spivak, McClelland, Maier & Neustadt, P.C.

(57) ABSTRACT

Improvements in thermal printing are described. Print energy absorbers are arranged so as not to alter printed characteristics of colorant. Pre-heaters lessen the amount of print energy necessary to effect printing. D2T2 printing with a laser print energy source is disclosed.

27 Claims, 1 Drawing Sheet

TRANSFER PRINTING

This application is a Continuation of application Ser. No. 08/523,335, filed on Sep. 5, 1995, now abandoned.

BACKGROUND OF THE INVENTION

1. Field of the Invention

The present invention relates to improvements in transfer printing, particularly to improvements in thermal transfer printing, which increase print energy efficiency and print quality. In a first embodiment an energy absorber is arranged in a transfer printing medium such that it absorbs applied energy necessary for the transfer of indicia-forming material without degrading quality and/or color characteristics of the printed indicia-forming material. In a second embodiment, the efficiency, speed and range of printing energy suppliers available for transfer printing is increased by heating a transfer printing medium prior to or during the application of print energy.

2. Discussion of the Background

Transfer printing is a generic term for processes in which one or more print indicia materials (i.e., dyes, dispersions, colorants, etc.) are caused to transfer from one medium to a receiver surface in response to an external stimulus. See U.S. Pat. Nos. 4,614,521, 4,657,557, 4,748,151, 4,771,035, 4,816,435, 4,820,685, 4,829,049, 4,895,830, 4,954,478, 4,981,748, 4,985,396, 4,988,666, 5,013,606, 5,139,995, 5,143,782, 5,189,008, 5,236,768, 5,256,492, 5,292,583, 5,308,681, 5,314,862, 5,324,583, 5,350,730, 5,004,659, and 5,008,152 (referred to hereinafter in connection with the present invention) as well as "PC Computing", September 1993, especially pages 174–175 thereof, all incorporated herein by reference. Perhaps the most popular area of transfer printing is thermal transfer printing wherein thermally transferable dyes are caused to transfer from a medium such as a dyesheet to, e.g., a piece of paper. Such thermal transfer printing has been used in the past for printing woven and knitted textiles and various other rough materials by placing over the material to be printed on a sheet carrying the desired pattern in the form of sublimable dyes. Common commercial forms of such materials are "iron-on" images popular for children's clothes.

A more recent thermal transfer printing process is one used to produce indicia on a surface, typically a piece of coated or plain paper, using pixel printing equipment including thermal energy sources such as thermal pin printers, or light energy sources including laser beams, etc whose energy is converted to thermal energy when absorbed. Typically, the print energy source (thermal print head, laser printer, etc.) is controlled by electronic signals derived from video, computer, electronic camera, or similar signal generating apparatus. The pattern to be printed need not be pre-formed on a print medium such as a dyesheet, and a medium is used which typically comprises a thin substrate supporting at least one transfer coat having single or multiple print indicia materials (dyes, dispersions, etc.) contained therein and forming, typically, a continuous and uniform layer over an entire printing area of the medium. Examples of printing techniques using such media include thermal wax printing, sublimation dye printing, dye diffusion thermal transfer printing, dye transfer printing, etc.

Typical examples of print media include printing ribbons such as those commonly used in office products to carry coloring materials onto a receiver sheet. Printing is typically effected by heating selected discrete areas of the medium, e.g., dyesheet, while the transfer coat is held against a dye,receptive surface such as coated or plain paper, causing a colorant, e.g., a dye, to transfer onto the corresponding areas of the receptive surface. The shape of the pattern transferred is determined by the number and location of areas which were subjected to heating, and the. depth of the shade in any area is determined by the period of time for which it is heated, and the temperature reached. Printing which is thought to rely on the diffusion of a dye to a receptive surface is typically referred to as dye diffusion thermal transfer printing, or D2T2 printing. Printing according to D2T2 is quite popular in the Uunited States, including the printing of colored indicia by this method. D2T2 printing is currently limited, however, to thermal print head, etc. print energy suppliers, the expense and power of a laser necessary to affect D2T2 printing currently being to high. Sublimation dye printing, where a dye is thought to be converted to the gas phase from the solid phase and deposited on a receiver sheet or surface, and thermal wax printing, where a wax binder is melted and transferred, are also popular. All. these printing methods are referred to herein "thermal printing" since printing requires thermal energy. The term "print energy" as used herein includes all energies that effect thermal printing, including heat, light, etc.

Typical dyesheets useful in thermal printing, including printing ribbons, etc., generally are made from a sheet-like substrate such as paper, polymeric resins, etc. which support on one surface thereof a transfer coat containing a thermally transferable dye, typically contained within a polymeric or wax binder. Additional coating layers may also be present, including adhesive or dye-barrier sublayers between the substrate and transfer coat, and back coats on a second surface for improving slip or heat resistance properties. See, for example, the above list of U.S. patents incorporated herein by reference for examples of substrates, binders, dyes, etc. Such dyesheets may be elongated and/or housed in a cassette for convenience, enabling them to be wound so as to expose fresh areas of transfer coat after each print event has occurred.

Thermal transfer printing media designed for producing multicolored prints have a plurality of panels of different uniform colors, typically three or four, including yellow, magenta and cyan and sometimes black. When supported on a substrate elongated in the form of a ribbon these different panels may be provided as longitudinal parallel strips or as transverse panels, each the size of the desired print arranged in a repeated sequence of the color used. During printing, panels of each color are placed on or near the receiver sheet and energy is, applied thereto by means of a thermal head, laser, etc., to effect transfer of the dye as required. The initial print indicia can be overprinted by a subsequent color to make up the full color spectrum.

In order to increase the efficiency of thermal transfer printing, it is typical to include an energy absorber, typically an IR energy absorber, within the transfer coat and mixed in contact with the dye to be transferred in order to improve transfer efficiency by increasing the efficiency of energy absorption by the print-transferring medium. Unfortunately, such energy absorbers, which are typically chemical species, interfere with and change the color of the printed indicia by, e.g., interfering with the dye color. This contamination often makes it impossible to print true yellow, true magenta, true cyan, etc. and significantly impacts the application of transfer printing such as D2T2 printing. The alternative, of course, is to use no energy absorber, but this solution leads to a situation where the amount of energy applied to the print ribbon, transfer coat, etc., must be unacceptably increased, resulting in blurred images, damaged printing ribbons, etc.

Moreover, and as mentioned above, due to the relatively high energy requirements necessary to effect D2T2 printing, especially with commercially available D2T2 print ribbons, the use of lasers as print energy suppliers for transfer indicia writers is generally commercially unknown.

SUMMARY OF THE INVENTION

Accordingly, one object of this invention is to provide a novel transfer printing medium which includes an energy absorber which does not interfere with the printed characteristics, especially the color, of the dye, dispersion, etc. (hereinafter referred to as colorant) transferred therefrom during printing.

Another object of the present invention is to provide a transfer printing method in which the amount of energy required to be supplied from the print head to effect transfer printing is decreased.

Another object of the present invention is to provide a transfer printing method wherein a laser beam is used as a print head to supply the print energy necessary to effect transfer of colorant from a transfer printing medium to a receiver surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
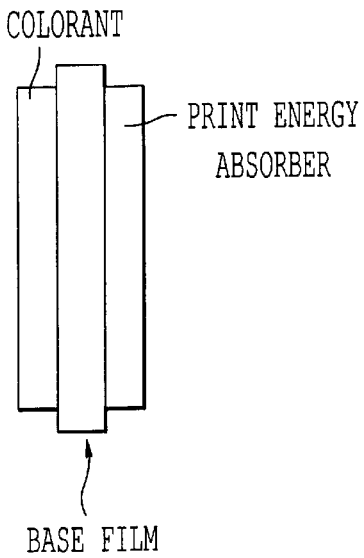
FIG. 1 depicts three separate embodiments of the first aspect of the present invention wherein a transfer printing medium is provided comprising a base film having arranged thereon a separate transfer coating layer comprising colorant and a print energy absorbing material arranged such that the print energy absorbing material does not affect the color characteristics of the printed colorant.

In a first aspect of the present invention a thermal transfer printing medium is provided comprising a substrate, a transfer coat and at least one print energy absorber. The substrate according to the present invention can be any substrate typically used in the printing art, including paper, polymeric resins, etc., and is typically formed in the shape of a sheet, a ribbon, etc. See the list of U.S. patents referred to above for examples. Size and thickness of the present invention substrate is not limited. Thermoplastic films such as polyester films sold under the trademark MYLAR, etc. are particularly preferred, but the present invention includes any and all substrates useful for supporting a transfer coat and capable of containing or supporting a print energy absorber. Preferred substrates are those typically used in printing processes such as thermal transfer printing, etc.

The present invention substrate supports a transfer coat which contains a colorant to be transferred to a receiving surface so as to form an indicia, including images, etc. Typically, the transfer coat contains a dye, preferably a dye useful in thermal transfer printing such as D2T2 printing, etc., particuarly those described in the above-referenced U.S. patents, but may instead contain a dispersion, etc. which can be transferred to a receiver surface by the application of energy, preferably thermal energy (including laser energy). See the U.S. patents listed above for examples of print energy suppliers. The transfer coat according to the present invention typically further comprises a binder in which the dye, dispersion, etc. is contained. Any binder may be used, including cellulosic polymers, polyvinylbutyral, etc. See the U.S. patents listed above for examples.

The print energy absorber according to the present invention is any material which is capable of absorbing the print energy applied to a thermal transfer printing medium to effect printing. Such energy absorbers are typically IR absorbers, laser energy absorbers, thermal energy absorbers, etc. and include all substances which absorb the print energy applied to the transfer printing medium so as to effect printing. See the U.S. patents and publications above for examples.

According to the present invention, the components of the thermal transfer printing medium are arranged such that the energy absorber is not contained within the transfer coat in such a manner that the printed color of the colorant indicia forming material therein (dyes, dispersions, etc.) is affected when printed on a surface. In one preferred embodiment the print energy absorber is arranged such that it is in a separate layer arranged beneath the transfer coat, typically on a surface of the substrate opposite the surface with the transfer coat. See FIG. 1*a*. In a second preferred embodiment, the present invention transfer printing medium includes a substrate which itself incorporates the print energy absorber. On the substrate is contained the transfer coat. See FIG. 1*b*. In a third preferred embodiment of the present invention, the energy absorber is arranged in a separate layer and underneath the transfer coat. See FIG. 1C. Additional barrier layers to prevent intermixing of the print energy absorber and the transfer coat can be used, as well as other layers, materials, etc. generally known in the art for thermal print media. See the above-listed U.S. patents for examples of such additives, etc.

It is to be noted that in the present invention the print energy absorber may itself be dispersed within a binder, etc., and form a separate layer on the substrate, or may be dispersed within the substrate layer. See the U.S. patents listed above for examples of binders, substrate materials, etc. Other arrangements are also possible, as long as the print energy absorber is arranged such that it is not contained within the transfer coat in such a manner that it affects the printed properties, particularly the color printed properties, of the colorant indicia-forming material contained within the transfer coat. In a preferred embodiment the transfer coat contains no print energy absorbers.

In a second aspect of the present invention, the efficiency of transfer printing, especially thermal transfer printing, is increased by the transfer coat of a thermal transfer printing medium prior to and/or during (meaning concomitant with) printing by, e.g., a thermal head or a laser beam. See FIG. 2A for laser beam printing, and FIG. 2B for thermal head printing. Any type of separate (i.e., separate from the print energy source) heating can be used. Heating can occur as in FIG. 2, can occur at the point where print energy is applied, etc. including combinations thereof. Any type of thermal transfer printing in which colorant is transferred to a receiving surface by heat, laser energy, etc. is included in this aspect of the present invention, and the separate heating (i.e., heating by means other than the print energy means such as a thermal head, etc.) of the transfer printing medium can occur to any extent desired up until the transfer printing medium is not suitable for printing due to, e.g., melted binder in the transfer coat, etc. Using this technique, laser print energy in thermal printing, especially in a D2T2 recording environment, is practical, as it is for all thermal transfer systems. Lasers providing power of, e.g., 0.3–12 W, preferably 0.5–4 W, can be used to print at speeds of, e.g. 1 page per minute. See Table 1 below for several minimum energy requirements for different recording methods. In view of the second aspect of the present invention, these minimum energy requirements now can be applied to the transfer printing medium not only by the indicia-forming print energy supplier in the form of a thermal head, a laser beam, etc., but can be supplied by a combination of a separate heating element and a traditional indicia-forming energy supplier (printhead, laser beam, etc.).

TABLE 1

| | <MINIMUM ENERGY FOR RECORDING> | | |
|---|---|---|---|
| METHOD | MINIMUM ENERGY TO GET 1.0 ID ($mJ/mm^2$) | MINIMUM MASS TO GET 1.0 ID | MATERIAL OF IMAGE |
| SILVER HALIDE | $10^{-8}$–$10^{-6}$ ($10^{-7}$–$10^{-8}$ sec) | $10^{18}$ atom/$cm^2$ $10^{16}$ molecule/$cm^2$ | Ag/Dye |
| ELECTROPHOTOGRAPHY | $10^{-6}$–$10^{-4}$ ($10^{-8}$–$10^{-7}$ sec) | $10^{17}$ atom/$cm^2$ | Toner |
| DIAZO | 3–5 | $10^{16}$ molecule/$cm^2$ | DIAZO |
| DIELECTRIC | 1–4 ($10^{-4}$ mJ/dot) | $10^{17}$ atom/$cm^2$ | Liquid Toner |
| INKJET | <1 (10 mJ/dot) | $10^{18}$ molecule/$cm^2$ | Dye/Pigment |
| DIRECT THERMAL | 80–100 | $10^{16}$ molecule/$cm^2$ | Dye |
| WAX THERMAL | 40–60 (20–50)* | $10^{17}$ atom/$cm^2$ | Wax |
| D272 | 90–120 (40–60)* | $10^{18}$ molecule/$cm^2$ | Dye |

*Electric Head

The method and manner of separately heating the thermal transfer printing medium according to the invention is not particularly limited herein. Instead, any kind of heating element including a resistance heater, hot air blower, IR heater, radiant lamp, etc. all can be used to heat the transfer printing medium before or while print indicia-forming energy is applied thereto. Heating can be applied to the thermal transfer medium before it reaches the print area and/or while it is at the print area. Naturally, a combination of separate heating according to the second aspect of present invention and proper arrangement of a print energy absorber in a thermal transfer printing medium according to the first aspect of the present invention provide the benefits of both embodiments of the present invention. In addition, if separate heating according to the second aspect of the invention is to be used, the transfer printing medium can contain a thermal energy absorber and an absorber to absorb print energy if these two energies are different. Both embodiments of the present invention can be used with all existing thermal transfer printing methods and media including the several methods, thermal transfer dyesheets, etc. described in the U.S. Patents listed above and incorporated herein by reference and U.S. Pat. Nos. 5,326,622, 5,011,815, 5,100,861, 4,558,329 and 4,988,667, also incorporated herein by reference.

The second embodiment of the present invention is particularly advantageous when the primary print energy-suppling supplying source for forming indicia (i.e., printing) is a laser source and the thermal transfer printing medium is a direct dye thermal transfer medium such as a dyesheet or ribbon. Such an arrangement is currently completely impractical since such printing requires a laser which is expensive and provides at least 30 W of total power. By pre-heating the thermal transfer printing medium with, e.g., hot air, commercially available low energy lasers of e.g., 0.8 W may now be used for D2T2 printing. This is a significant advance in the art.

The present invention will now be described by reference to several Examples. The Examples are not limiting but are instead provided to enhance the readers understanding of the present invention.

EXAMPLES

Figure 2A:
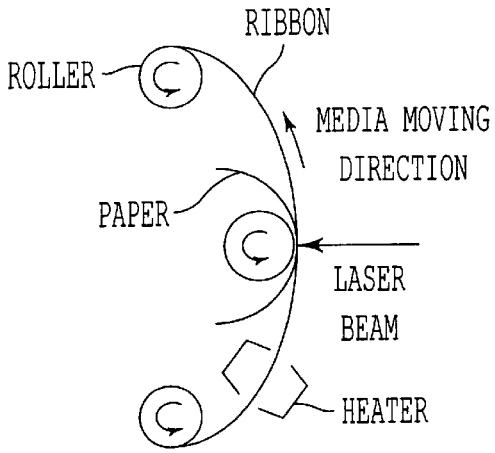
FIG. 2 shows a second aspect of the present invention wherein a transfer printing medium such as a print ribbon is pre-heated prior to the application of print energy from e.g., a laser or thermal head, to effect printing.
Figure 2B:
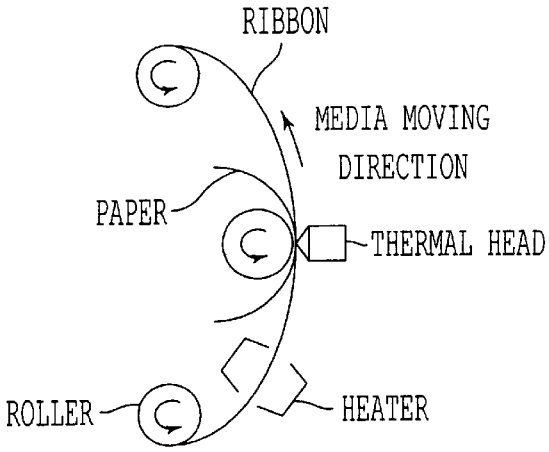

In all the Examples, D2T2 printing was accomplished using a 0.8 W laser as the print energy source and a printing arrangement as in FIG. 2A.

In the first Example, a transfer sheet (Mitsubishi Chemical) consisting of a layer of carbon black (serving as the print energy absorber) sandwiched.between a transfer coat (containing an IR absorber and colorant) and substrate was used. The comparative IR-enhanced transfer sheet was the same but had no carbon black layer. See FIG. 1C. Pre-heating was accomplished with hot air. Results obtained are described in Table 2 below:

| Format | IR - Enhanced | | | Carbon Black Sandwich Layer | | |
|---|---|---|---|---|---|---|
| Color vertical line printed by 0.8 W laser beam. | Yellow Greenish | Magenta Dark Magenta | Cyan Cyan | Yellow Yellow | Magenta Magenta | Cyan Cyan |

As shown by the results in above Table, the IR enhanced ribbon prints a greenish color instead of a yellow color without the invention energy absorber due to the IR energy-absorber contained in the transfer coating layer which interferes with the dye. However, the same ribbon prints yellow when configured according to the present invention and having a energy absorbing layer as a backing layer. This indicates that I R-enhanced ribbons, which are the current state of the art, can be improved according to the present invention. In addition, and due to the present invention, IR-enhancers will no longer be added to the transfer coat in a manner that allows them to interfere with the dye.

Figure 1B:
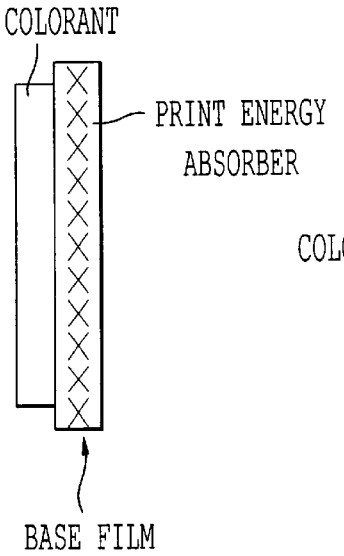
Figure 1C:
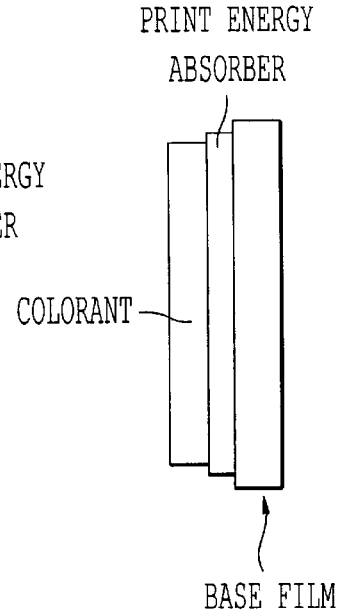

In a second experiment, a D2T2 thermal transfer sheet without IR absorber was prepared with and without a Fargo Electronics black ribbon as a carbon black back coating on a tri-colored ribbon according to FIG. 1A. The results are shown in the following Table:

| D2T2 Ribbon | Without Black Fargo Ribbor. | With Black Fargo Ribbon |
|---|---|---|
| Cyan | Vertical Line: YES | Vertical Line: YES |
| Magenta | Vertical Line: NO | Vertical Line: YES |
| Yellow | Vertical Line: NO | Vertical Line: YES |

which show the present invention allows for all colors to be printed with a laser beam, as opposed to printing ribbons with no invention energy absorbing layer. Without the invention energy absorber the laser is ineffective at printing magenta or yellow.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A thermal transfer printing medium, comprising:

(A) a substrate; and (B) a transfer coating layer, said transfer coating layer comprising a colorant, wherein a print energy absorber is incorporated in said substrate.

2. The thermal transfer printing medium of claim 1, wherein said substrate is a thermoplastic sheet in which a print energy absorber is incorporated.

3. The thermal transfer printing medium of claim 2, wherein said thermoplastic is a polyester film.

4. The thermal transfer printing medium of claim 1, wherein said print energy absorber is selected the group consisting of IR absorbers, laser energy absorbers, and thermal energy absorbers.

5. The thermal transfer printing medium of claim 1, wherein said print energy absorber is carbon black.

6. The thermal transfer printing medium of claim 1, wherein said substrate is a thermoplastic sheet in which a print energy absorber is incorporated and said print energy absorber is selected from the group consisting of IR absorbers, laser energy absorbers, and thermal energy absorbers.

7. The thermal transfer printing medium of claim 6, wherein said thermoplastic is a polyester film and said print energy absorber is carbon black.

8. The thermal transfer printing medium of claim 1, wherein said transfer coating layer further comprises a binder.

9. The thermal transfer printing medium of claim 8, wherein said binder is selected from the group consisting of cellulosic binders and polyvinylbutyral.

10. The thermal transfer printing medium of claim 1, which is a dye diffusion thermal transfer printing; medium.

11. The thermal transfer printing medium of claim 10, wherein said substrate is a thermoplastic sheet in which a print energy absorber is incorporated.

12. The thermal transfer printing medium of claim 11, wherein said thermoplastic is a polyester film.

13. The thermal transfer printing medium of claim 10, wherein said print energy absorber is selected from the group consisting of IR absorbers, laser energy absorbers, and thermal energy absorbers.

14. The thermal transfer printing medium of claim 10, wherein said print energy absorber is carbon black.

15. The thermal transfer printing medium of claim 10, wherein said substrate is a thermoplastic sheet in which a print energy absorber is incorporated and said print energy absorber is selected from the group consisting of IR absorbers, laser energy absorbers, and thermal energy absorbers.

16. The thermal transfer printing medium of claim 15, wherein said thermoplastic is a polyester film and said print energy absorber is carbon black.

17. The thermal transfer printing medium of claim 10, wherein said transfer coating layer further comprises a binder.

18. The thermal transfer printing medium of claim 17, wherein said binder is selected from the group consisting of cellulosic binders and polyvinylbutyral.

19. The thermal transfer printing medium of claim 1, which is a thermal wax printing medium.

20. The thermal transfer printing medium of claim 19, wherein said substrate is a thermoplastic sheet in which a print energy absorber is incorporated.

21. The thermal transfer printing medium of claim 20, wherein said thermoplastic is a polyester film.

22. The thermal transfer printing medium of claim 19, wherein said print energy absorber is selected from the group consisting of IR absorbers, laser energy absorbers, and thermal energy absorbers.

23. The thermal transfer printing medium of claim 19, wherein said print energy absorber is carbon black.

24. The thermal transfer printing medium of claim 19, wherein said substrate is a thermoplastic sheet in which a print energy absorber is incorporated and said print energy absorber is selected from the group consisting of IR absorbers, laser energy absorbers, and thermal energy absorbers.

25. The thermal transfer printing medium of claim 24, wherein said thermoplastic is a polyester film and said print energy absorber is carbon black.

26. The thermal transfer printing medium of claim 19, wherein said transfer coating layer further comprises a binder.

27. The thermal transfer printing medium of claim 26, wherein said binder is selected from the group consisting of cellulosic binders and polyvinylbutyral.

* * * * *